US009245509B2

(12) United States Patent
Fujiwara et al.

(10) Patent No.: US 9,245,509 B2
(45) Date of Patent: Jan. 26, 2016

(54) RECORDING AND REPRODUCTION OF WAVEFORM BASED ON SOUND BOARD VIBRATIONS

(71) Applicant: YAMAHA CORPORATION, Hamamatsu-shi, Shizuoka-Ken (JP)

(72) Inventors: Yuji Fujiwara, Hamamatsu (JP); Shinya Koseki, Fukuroi (JP); Fukutaro Okuyama, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 9 days.

(21) Appl. No.: 14/095,126

(22) Filed: Dec. 3, 2013

(65) Prior Publication Data

US 2014/0150624 A1 Jun. 5, 2014

(30) Foreign Application Priority Data

Dec. 3, 2012 (JP) ..... 2012-264191

(51) Int. Cl.

| | |
|---|---|
| ***G10H 3/12*** | (2006.01) |
| ***G10H 3/14*** | (2006.01) |
| ***G10H 3/22*** | (2006.01) |
| ***G10C 3/06*** | (2006.01) |

(52) U.S. Cl.

CPC .. *G10H 3/12* (2013.01); *G10C 3/06* (2013.01); *G10H 3/14* (2013.01); *G10H 3/146* (2013.01); *G10H 3/22* (2013.01); *G10H 2230/065* (2013.01)

(58) Field of Classification Search

CPC ..... G10H 3/12; G10H 3/14; G10H 3/146; G10H 3/22

See application file for complete search history.

(56) References Cited

U.S. PATENT DOCUMENTS 5,262,586 A * 11/1993 Oba et al. ..... 84/723
7,572,970 B2 * 8/2009 Gouhara et al. ..... 84/625

(Continued)

FOREIGN PATENT DOCUMENTS

EP 1357538 A2 10/2003
JP 04191894 A 7/1992

(Continued)

OTHER PUBLICATIONS

Extended European Search Report issued in corresponding European Patent Application No. 13195264.0 dated Apr. 17, 2014.

(Continued)

*Primary Examiner* — David Warren

(74) *Attorney, Agent, or Firm* — Rossi, Kimms & McDowell LLP

(57) ABSTRACT

In a musical instrument, such as a piano, having a sound board, the sound board vibrates in response to vibrations of a string responsive to depression of a key. A waveform corresponding to such vibrations of the sound board is detected and recorded into a memory for each of the keys. The recorded vibration waveform is usable for reproduction of a sound based on sound board vibrations. In a sound reproduction apparatus, such as a piano, having a sound board, an excitation device physically excitable in response to an input waveform is provided on the sound board. In response to an operation of a key, a sound board vibration waveform corresponding to the operated key is read out from the memory, and the excitation device is driven in accordance with the read-out waveform signal so that the sound board is vibrated.

6 Claims, 7 Drawing Sheets

(56) References Cited

U.S. PATENT DOCUMENTS

| | | | | |
|---|---|---|---|---|
| 7,786,374 | B2 * | 8/2010 | Valli et al. | 84/737 |
| 8,878,045 | B2 * | 11/2014 | Koseki et al. | 84/616 |
| 2003/0015086 | A1 * | 1/2003 | Katz | 84/644 |
| 2007/0017353 | A1 * | 1/2007 | Kunisada et al. | 84/723 |
| 2007/0079693 | A1 * | 4/2007 | Valli et al. | 84/723 |
| 2009/0241756 | A1 | 10/2009 | Tajima et al. | |
| 2012/0247309 | A1 | 10/2012 | Matsuda | |

FOREIGN PATENT DOCUMENTS

| | | | |
|---|---|---|---|
| JP | 05-73039 | A | 3/1993 |
| JP | 05073038 | A | 3/1993 |
| JP | 2003186476 | A | 7/2003 |
| JP | 2006-524350 | A | 10/2006 |
| JP | 2012203347 | A | 10/2012 |

OTHER PUBLICATIONS

Japanese Office Action cited in Japanese application No. JP2012-264190, dated Jan. 30, 2015. English translation provided.

Extended European Search Report issued in European application No. EP13195265.7, dated Apr. 14, 2015.

Non Final Office Action issued in copending U.S. Appl. No. 14/095,048, dated Jul. 2, 2015.

* cited by examiner

RECORDING AND REPRODUCTION OF WAVEFORM BASED ON SOUND BOARD VIBRATIONS

BACKGROUND

The present invention relates generally to a technique which, in a musical instrument provided with a sound board to which physical vibrations of a sounding member like a string are transmitted, permits recording of a vibration waveform related to vibrations of the sound board, and also relates to a sound reproduction apparatus, such as a musical instrument like a piano, capable of generating an audible sound by vibrating a sound board in accordance with a drive signal indicative of a vibration waveform of the sound board.

Examples of the conventionally-known pianos include ones known, for example, from Japanese Patent Application Laid-open Publication No. HEI-5-73039 and Published Japanese Translation of International Patent Application No. 2006-524350, which can compulsorily vibrate a sound board by an actuator in accordance with a drive signal in addition to vibrations caused by striking of strings.

In the piano disclosed in Japanese Patent Application Laid-open Publication No. HEI-5-73039, vibrations of any one of the strings and the sound board during a performance are detected via vibration sensors and a microphone, DSP processing is performed on the detected vibrations to generate a sound board drive signal so that the actuator is driven to vibrate the sound board within five msec from sound generation by striking of the string. Thus, a sound generated by vibrations of the sound board via the actuator is added to a sound of an acoustic piano, so that it is possible to set as desired a type and variation amount of an audio effect to be imparted in a performance.

However, with the piano disclosed in Japanese Patent Application Laid-open Publication No. HEI-5-73039, where the sound board and the strings are in such a relationship that vibrations are transmitted mutually between them, a resonant sound resulting from compulsory vibrations of the sound board etc. are generated in addition to a sound generated by striking of any one of the strings. Thus, the sound generated by the string striking and the sound by the compulsory vibrations of the sound board mix together to cause a resonant-sound overlapping state, so that an unintended acoustic effect may be undesirably produced.

Because sounds of different quality from original sounds of the acoustic piano are generated for the foregoing reason, the technique disclosed in the No. HEI-5-73039 publication differs from a technique intended to faithfully replicate or reproduce original acoustic characteristics of an acoustic piano in a performance. In addition, the technique disclosed in the No. HEI-5-73039 publication is not a technique designed to execute automatic reproduction using data obtained by recording a performance. Further, because the technique disclosed in the No. HEI-5-73039 publication is constructed to merely generate sounds by compulsory vibrations of the sound board in addition to sounds generated by string striking, it can hardly adjust sound volumes during a performance. Further, Published Japanese Translation of International Patent Application No. 2006-524350 does not disclose recording and reproducing vibrations of the sound board.

SUMMARY OF THE INVENTION

In view of the foregoing prior art problems, it is an object of the present invention to provide an improved musical instrument which can record a vibration waveform pertaining to vibrations of a sound board rather than vibrations of a sounding member, such as a string, that is a primary vibration sound source of the musical instrument. It is another object of the present invention to provide an improved sound reproduction apparatus which can generate a sound by driving the sound board on the basis of such a vibration waveform. It is still another object of the present invention to provide a piano which can not only faithfully reproduce, in a performance, acoustic characteristics of, for example, an acoustic piano but also permits sound volume adjustment.

In order to accomplish the above-mentioned objects, the present invention provides an improved musical instrument, which comprises: a plurality of performance operation keys; a plurality of sounding members provided in corresponding relation to the plurality of performance operation keys; a sound board; a plurality of striking members provided in corresponding relation to the plurality of performance operation keys and each configured to physically vibrate a corresponding one of the sounding members in response to an operation of the corresponding one of the performance operation keys; a plurality of transmission joints provided in corresponding relation to the plurality of sounding members and each disposed in such a manner as to physically transmit vibrations of a corresponding one of the sounding members to the sound board; a vibration waveform detector configured to detect a vibration waveform corresponding to vibrations of at least one of the sound board and the transmission joints; and a controller configured to perform control for storing the vibration waveforms detected by the vibration waveform detector, in response to respective operations of the performance operation keys, into a memory in association with individual ones of the performance operation keys.

According to the musical instrument of the present invention, control can be performed such that a vibration waveform pertaining to vibrations of the sound board rather than vibrations of the sounding member (such as a string) that is a primary vibration sound source of the musical instrument are recorded for each of the performance operation keys. Thus, the vibration waveform recorded for each of the performance operation keys can be advantageously used for generation of a sound corresponding to the performance operation key. For example, when any one of the performance operation keys has been operated, the vibration waveform corresponding to the operated performance operation key is read out from the memory, and the sound board is excited on the basis of the read-out vibration waveform so that a sound based on vibrations of the sound board can be reproduced.

In one embodiment, the vibration waveform stored by the controller into the memory may be a vibration waveform of an attack section of a sound. Thus, it is possible to save a necessary storage amount of the vibration waveform corresponding to each one of the performance operation keys to be stored into the memory, but also perform faithful reproduction of a sound when the sound is to be reproduced through excitation of the sound board according to the stored vibration waveform. Namely, in the reproduction, the sound board is excited on the basis of the vibration waveform of the attack section to thereby reproduce a sound based on vibrations of the sound board, in which case a sound of a sustain section or decay section following the attack section can be obtained by spontaneous sustained or attenuated vibrations of the sound board. Such arrangements can replicate or reproduce as faithfully as possible a sound board vibration phenomenon responsive to striking of the sounding member.

According to another aspect of the present invention, there is provided an improved sound reproduction apparatus, which comprises: a sound board; an excitation device physically excitable in accordance with an input waveform signal and disposed in such a manner that physical vibrations generated by the excitation device are transmitted at least to the sound board; a plurality of performance operation keys; an operation detector configured to detect respective operations of the plurality of performance operation keys; a memory storing therein vibration waveforms corresponding to individual ones of the plurality of performance operation keys in association with the individual ones of the plurality of performance operation keys; and a controller is configured to read out, from the memory, the vibration waveform corresponding to the performance operation key whose operation has been detected by the operation detector and input a waveform signal based on the read-out vibration waveform to the excitation device, so that physical vibrations according to the input waveform signal are generated by the excitation device and a sound is generated by at least the sound board physically vibrating in response to the physical vibrations generated by the excitation device. According to the sound reproduction apparatus, when any one of the performance operation keys has been operated, the vibration waveform corresponding to the operated performance operation key is read out from the memory, and the sound board is driven on the basis of the read-out vibration waveform. Thus, the present invention can generate a sound based on the sound board vibrations responsive to the operation of the performance operation key.

Preferably, the sound reproduction apparatus is mounted on the musical instrument, and the excitation device is a device comprising the same hardware as the vibration waveform detector. Such an arrangement can even more faithfully reproduce the same acoustic characteristics as presented in data recording, but also achieve a simplified construction.

Preferably, the sound reproduction apparatus further comprises: a plurality of sounding members provided in corresponding relation to the plurality of performance operation keys, each of the sounding members physically vibrating in response to an operation of a corresponding one of the performance operation key; a prevention device configured to prevent the sounding members from physically vibrating in response to operations of the performance operation keys. When selection is made of a mode in which a waveform signal based on any one of the vibration waveforms read out from the memory is input to the excitation device, the controller actuates the prevention device to prevent the sounding member from physically vibrating. Such an arrangement can prevent the sounding members from generating sounds and thus can generate a sound based purely on vibrations of the sound board.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

<First Embodiment>

Figure 1:
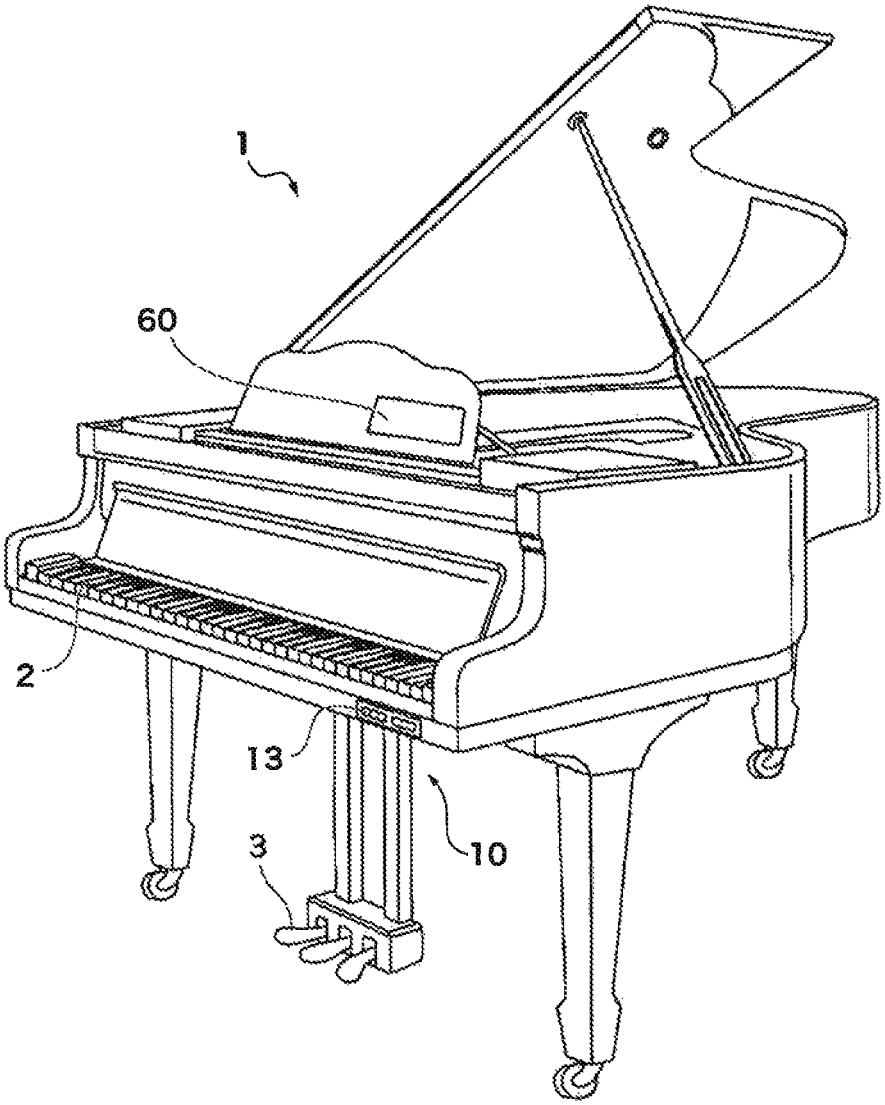
FIG. 1 is a perspective view showing an outer appearance of a first embodiment of a grand piano of the present invention.

FIG. 1 is a perspective view showing an overall outer appearance of a first embodiment of a piano of the present invention. This piano is constructed as a grand piano 1, which includes a keyboard having a plurality of keys 2 arranged on a front side thereof and operable by a human player for a performance and sound controlling pedals 3. The grand piano 1 further includes a sound generator device 10 having an operation panel 13 on a front surface portion thereof, and a touch panel 60 provided on a music stand portion of the piano. A user can input instructions to the sound generator device 10 by operating the operation panel 13 and the touch panel 60. The piano 1 has functions as a musical instrument equipped with a recording function according to the present invention and as a sound reproduction apparatus according to the present invention.

The grand piano 1 can be set in a plurality of sound generation modes in accordance with user's instructions. The plurality of sound generation modes include a string striking mode in which a sound is generated only by a hammer striking a corresponding string (more specifically, a set of one or more strings, but such a set of strings will hereinafter be referred to merely as a string) of the piano, and a string-striking preventing mode in which striking of a string by a hammer is prevented even when a corresponding key has been depressed. The string striking mode includes not only a normal performance mode similar to that of an ordinary grand piano, but also an automatic performance mode. Although the string-striking preventing mode may be set also as a so-called silencing mode in which only electronic sound generation is executed in place of sound generation by string striking, the string-striking preventing mode in the instant embodiment is capable of executing sound generation based on vibrations of a sound board in place of sound generation by string striking and without executing electronic sound generation. In the instant embodiment, the above-mentioned functions as the musical instrument equipped with the recording function according to the present invention can be performed in the string striking mode. Further, the functions as the sound reproduction apparatus according to the present invention can be performed in the string-striking preventing mode.

Figure 2:
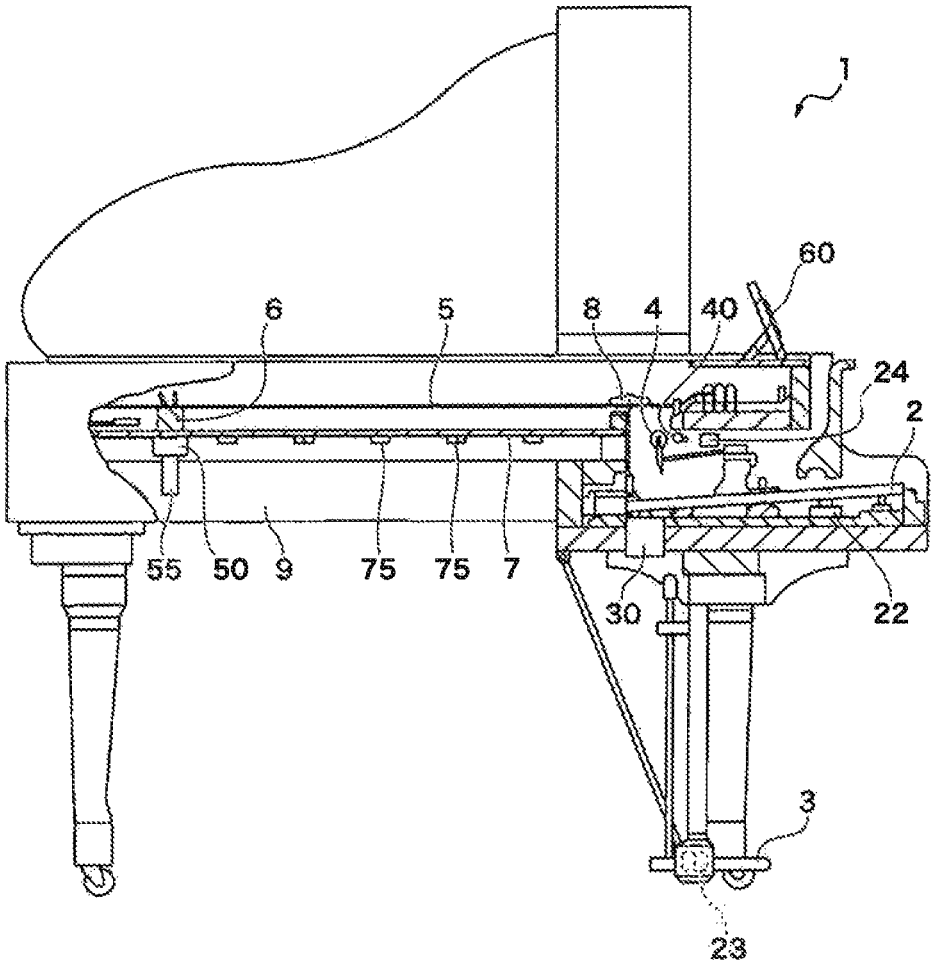
FIG. 2 is a sectional view showing an internal construction of the first embodiment of the grand piano.

FIG. 2 is a sectional view showing an internal construction of the grand piano 1. In FIG. 2, only a construction of one of the keys 2 and various sections corresponding to the one key 2 is shown for simplicity of illustration. Below a rear end portion (i.e., an end portion farther from a user or human player of the grand piano 1) of each of the keys 2 are provided a key drive unit 30 that drives the key 2 via a solenoid when the performance mode (sound generation mode) is the automatic performance mode or the like. The key drive unit 30 drives the solenoid in accordance with a control signal (or drive signal) given from the sound generator device 10. The key drive unit 30 reproduces a state similar to that when the user has depressed the key, by driving the corresponding solenoid to move upward the solenoid plunger. Also, the key drive unit 30 reproduces a state similar to that when the user has released the key, by moving downward the corresponding solenoid plunger. In the instant embodiment, the key 2 of the piano 1 is a performance operation key in the musical instrument equipped with the recording function according to the present invention, and the key drive unit 30 functions as a drive unit that automatically drives the performance operation key (key 2).

A plurality of strings 5 and hammers 4 are provided in corresponding relation to the keys 2. As any one of the keys 2 is depressed, the corresponding hammer 4 pivots via an action mechanism (not shown) to strike the corresponding string 5. A damper 8 is displaced in accordance with a depressed amount of the key 2 and a depressed amount of a damper pedal (hereinafter, the term "pedal 3" refers to the damper pedal unless stated otherwise) so that the damper 8 is placed out of contact with the string or in contact with the string 5. When the damper 8 is in contact with the string 5, it suppresses vibrations of the string 5. When any one of the keys 2 has been depressed, only the damper 8 corresponding to the depressed key 2 is displaced. In the instant embodiment, the string 5 is a sounding member of the musical instrument equipped with the recording function according to the present invention, and the hammer 4 is a striking member of that musical instrument. Further, the damper pedal 3 and the dampers 8 will hereinafter be referred to collectively as a damper device. The pedal drive unit 31 functions as a damper drive unit that automatically drives the damper device.

A stopper 40 is a string-striking preventing member or means which, while the grand piano 1 is in the string-striking preventing mode, operates to stop the hammers 4 and thereby prevent the hammers 4 from striking the strings 5. With the stopper 40 displaced to a position corresponding to the string-striking preventing mode, hammer shanks abut against the stopper 40 and thus are prevented from pivoting, so that the hammers 4 do not abut against the strings 5. In the string striking mode, however, the stopper 40 is kept evacuated to such a position as to not interfere with the hammer shanks.

A plurality of key sensors 22 are provided in corresponding relation to and beneath the individual keys 2 and output to the sound generator device 10 detection signals corresponding to behavior of the corresponding keys 2. For example, each of the key sensors 22 detects a depressed amount of the corresponding key 2 and outputs a detection signal indicative of the detection result to the sound generator device 10. Note that each of the key sensors 22 may be constructed to output a detection signal indicating that the corresponding key 2 has passed one or more particular depressed positions. The key sensor 22 functions as an operation detector that detects an operation of the performance operation key.

A plurality of hammer sensors 24 are provided in corresponding relation to the hammers 4 and output to the sound generator device 10 detection signals corresponding to behavior of the corresponding hammers 4. For example, each of the hammer sensors 24 detects a moving velocity of the corresponding hammer 4 immediately before striking the corresponding string 5 and outputs to the sound generator device 10 a detection signal indicative of the detection result. Note that each of the hammer sensors 24 may be constructed to output a detection signal indicating that the corresponding hammer 2 has passed one or more particular pivoted positions.

A plurality of pedal sensors 23 are provided in corresponding relation to the sound controlling pedals 3 and output to the sound generator 10 detection signals corresponding to behavior of the corresponding pedals 3. In the illustrated example, one of the pedal sensors 23 detects a depressed amount of the damper pedal 3 and outputs to the sound generator device 10 a detection signal indicative of the detection result. Note that the pedal sensor 23 may be constructed to output a detection signal indicating that the pedal 3 has passed a particular depressed position. The pedal sensor 23 for the damper pedal functions as a damper behavior detector that detects behavior of the damper device.

Here, the "particular depressed position" is preferably a depressed position by which it can be identified whether the string 5 and the damper 8 are in contact with each other or out of contact with each other. It is further preferable that a plurality of such particular depressed positions be provided to permit detection of a half-pedal state as well. Note that the detection signal output from the pedal sensor 23 may be any type of signal as long as it allows the sound generator device 10 to identify behavior of the pedal 3.

In order to execute a performance in the silencing mode, it is only necessary that, for each of the keys 2 (key numbers), the sound generator device 10 be capable of identifying a time of striking, by the hammer 4, of the string 5 (i.e., key-on time), striking velocity and a time of vibration suppression, by the damper 8, of the string 5 (key-off time) in accordance with detection signals output from the key sensor 22, pedal sensor 23 and hammer sensor 24. Thus, the key sensor 22, pedal sensor 23 and hammer sensor 24 may be constructed to output detected behavior of the key 2, pedal 3 and hammer 4 as any other desired forms of detection signals.

Ribs (braces or belly bars) 75 and bridges 6 are provided on the sound board 7, and the bridges 6 each engage a portion of the string 5 to support the string 5 in a stretched-taut state. Thus, vibrations of the sound board 7 are transmitted to the individual strings 5 via the bridges 6, and vibrations of the individual strings 5 are transmitted to the sound board 7 via the bridges 6. The bridges 6 are each a transmission joint disposed in such a manner as to physically transmit vibrations of the string 5 (sounding members) to the sound board 6.

Further, one or more vibration sensor/actuator units 50 is provided on the sound board 7. The vibration sensor/actuator units 50 each include an actuator having an excitation function for transmitting vibrations to the sound board 7, and a drive circuit for driving the actuator. The drive circuit amplifies a sound board drive signal (drive waveform signal) output from the sound generator 10 and supplies the amplified drive signal to the actuator so that the actuator is vibrated in accordance with a waveform indicated by the drive signal. Further, the vibration sensor/actuator unit 50 functions also as a vibration waveform detecting sensor that detects (picks up) a vibration waveform of the sound board 7.

The vibration sensor/actuator units 50 are each supported by a support section 55 connected to a straight strut 9 and are each connected to the sound board 7. Alternatively, the vibration sensor/actuator units 50 may each be supported by the sound board 7 without the support section 55 being used. In this case, the vibration sensor/actuator units 50 each transmit to the sound board 7 vibrations responsive to the drive signal by inertial force.

Figure 3:
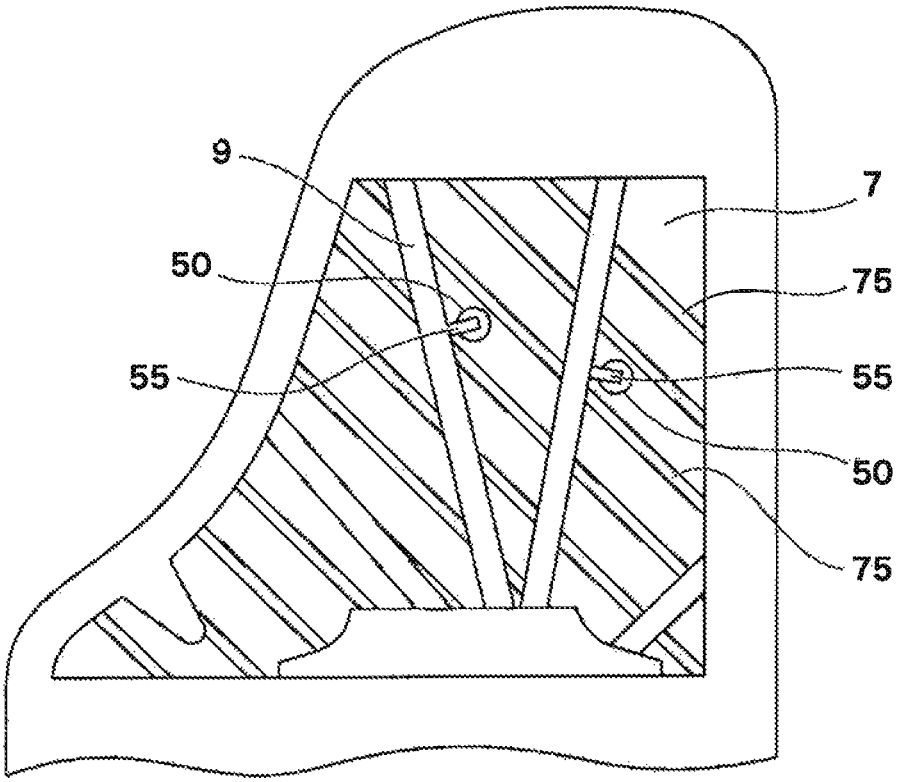
FIG. 3 is a bottom plan view of a sound board explanatory of mounted positions of vibration sensor/actuator units in the embodiment.

FIG. 3 is a bottom plan view of the sound board 7 explanatory of mounted positions of the vibration sensor/actuator units 50. The vibration sensor/actuator units 50 are each disposed on the sound board 7 between adjoining ones of the ribs (braces) 75 and connected to the sound board 7 in such a manner as to be capable of physically transmitting vibrations to the sound board 7. Although a plurality of the vibration sensor/actuator units 50 of a same construction are provided in the illustrated example, only one vibration sensor/actuator unit 50 may be provided. For convenience, the following description will be given on the assumption that only one vibration sensor/actuator unit 50 is provided.

As shown in FIG. 2, the vibration sensor/actuator unit 50 is disposed as close to the bridge 6 as possible. In the instant embodiment, the vibration sensor/actuator unit 50 is disposed on a side of the sound board 7 opposite from the bridge 6; in the illustrated example, each of the vibration sensor/actuators units 50 is disposed on a lower side of the sound board 7, while the bridge 6 is disposed on an upper side of the sound board 7. With the vibration sensor/actuator unit 50 disposed close to the bridge 6, there can be provided situations similar to those where the bridge 6 itself is excited and vibration waveforms of the bridge 6 themselves are detected. Namely, the vibration sensor/actuator unit 50 is a vibration waveform detector that detects a vibration waveform corresponding to vibrations of at least one of the sound board 7 and bridge 6 (transmission joint), but also constitutes an excitation device that is physically excited in accordance with an input waveform signal.

A device comprising a combination of a voice coil and a permanent magnet may be employed as a specific example of the vibration sensor/actuator unit 50, in which case the voice coil is connected to the sound board 7 while the permanent magnet is fixed to a piano frame or a suitable base. When the vibration sensor/actuator unit 50 should be caused to function as the vibration sensor, an AC signal induced from the voice coil in response to physical vibrations of the voice coil is output as a vibration waveform detection signal. When the vibration sensor/actuator unit 50 should be caused to function as the actuator (excitation device), a waveform signal is input to the voice coil so that the voice coil is physically vibrated in accordance with the input waveform signal.

Alternatively, the vibration sensor and the actuator may be constructed as separate devices. In such a case, the vibration sensor may comprise other than a combination of the voice coil and the permanent magnet; for example, the vibration sensor may comprise a strain detector, such as a piezoelectric device, another fine displacement detector or the like. Further, a suitable vibrator may be employed as the actuator (excitation device).

Figure 4:
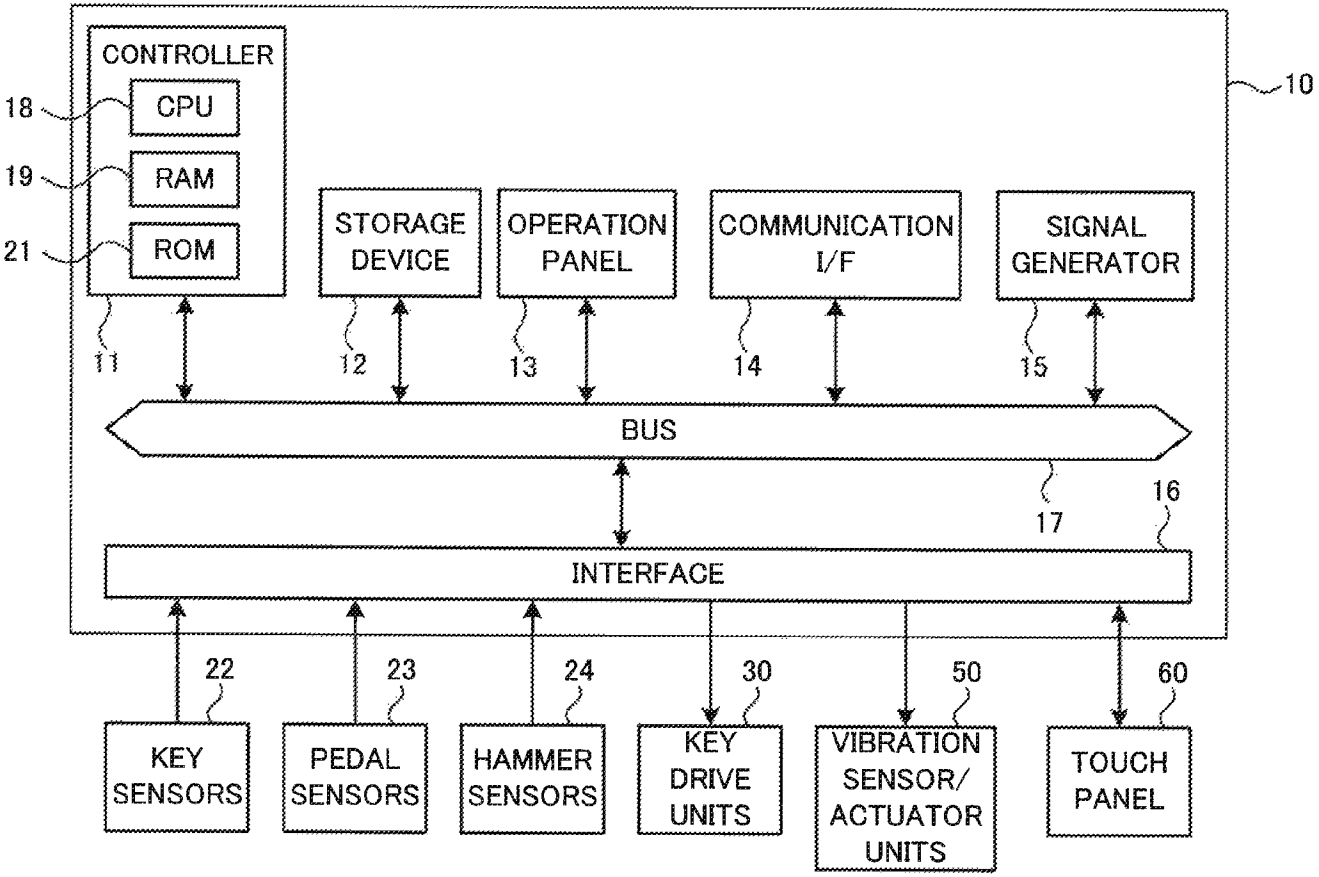
FIG. 4 is a block diagram showing a construction of a sound generator device of the embodiment of the grand piano.

FIG. 4 is a block diagram showing an overall construction of the sound generator device 10 of the grand piano 1 and other components related to the sound generator device 10. The sound generator device 10 includes a controller 11, a storage device 12, the operation panel 13, a communication I/F 14, a signal generation section 15 and an interface 16, and these components are interconnected via a bus 17.

The controller 11 includes a CPU 18 and storage devices such as a RAM 19, a ROM 21, etc. On the basis of control programs stored in the ROM 21, the controller 11 controls various sections of the sound generator device 10 and various components connected to the interface 16.

The storage device 12 stores therein setting information indicative of various setting content to be used while the control programs are being executed. The setting information is information that, on the basis of detection signals output from the key sensor 22, pedal sensor 23 and hammer sensor 24, determines content of drive signals to be generated in the signal generation section 15. The setting information includes, for example, a table defining relationship between depressed keys 2 and drive signals. The storage device 12 also stores "vibration waveform data" recorded in recording processing of FIG. 6.

The operation panel 13 includes operation buttons etc. operable by the user or capable of receiving user's operations. Once a user's operation is received via any one of the operation buttons, an operation signal corresponding to the operation is output to the controller 11. The touch panel 60 connected to the interface 16 has a display screen that displays thereon a setting screen for making settings for various modes and displays various information, such as a musical score. User's instructions to the sound generator device 10 can be input via any one of the operation panel 13 and the touch panel 60.

The communication I/F 14 is an interface for executing communication between the piano 1 and an external device in a wireless or wired manner. A disk drive for reading out various data stored in a recording medium may be connected to the communication I/F 14. Among data input to the sound generator device 10 via the communication I/F 14 are, for example, music piece data for use in an automatic performance.

The signal generation section 15 includes a sound generator that reads out the vibration waveform data from the storage device 12 and outputs the vibration waveform data as a drive signal after performing envelope adjustment on the vibration waveform data. More specifically, by referencing a not-shown fundamental-characteristic-key table, a fundamental-note-AEG (Amplitude Envelope Generator)-key table, etc. on the basis of the vibration waveform data etc., the signal generation section 15 adjust variation over time of the amplitude of the vibration waveform data and outputs the thus-adjusted vibration waveform data as the drive signal.

The interface 16 interconnects the sound generator device 10 and various external components. The interface 16 outputs to the controller 11 detection signals received from the key sensors 22, pedal sensor 23 and hammer sensors 24 and operation signals received from the touch panel 60. Further, the interface 16 outputs control signals from the controller 11 to the key drive unit 30 and pedal drive unit 31, but also outputs the drive signals from the signal generation section 15 to the vibration sensor/actuator unit 50.

Figure 5A:
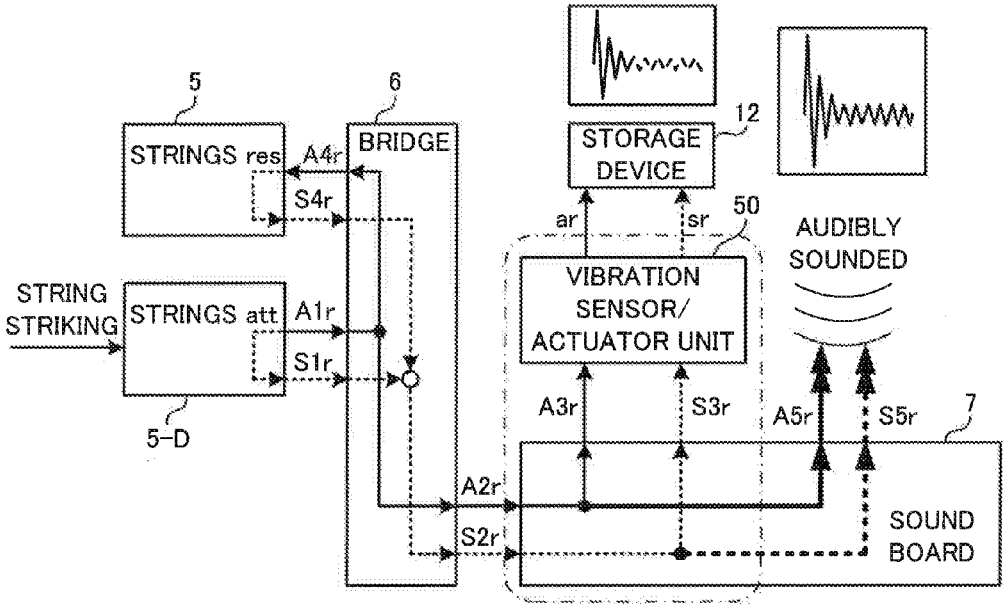
FIG. 5A is a diagram showing propagation paths of vibrations during recording processing where vibration waveform data are recorded in a string striking mode.
Figure 5B:
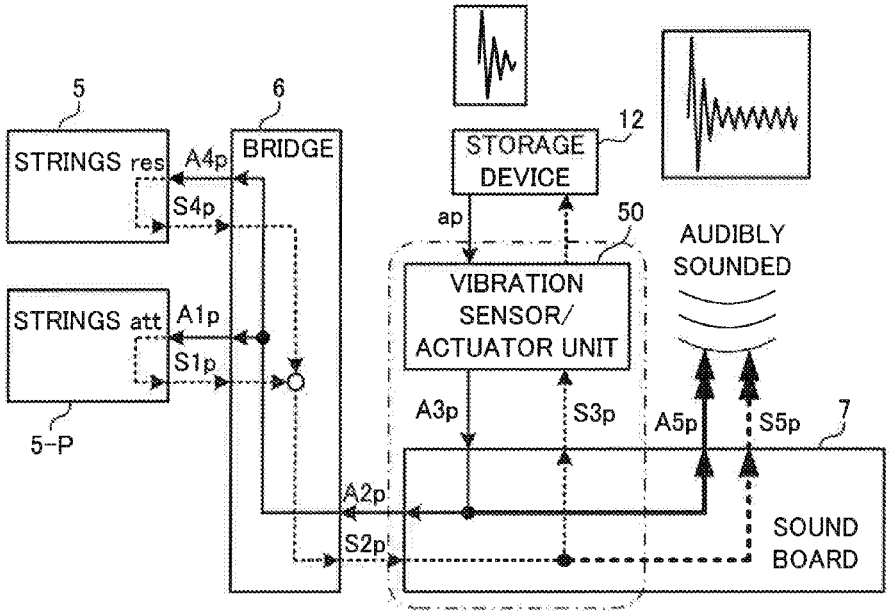
FIG. 5B is a diagram showing propagation paths of vibrations during sound board sound generation processing (reproduction processing) where tones (sound board vibration sounds) are audibly generated on the basis of vibration waveform data in a performance in a string-striking preventing mode.

FIG. 5A is a diagram showing vibration propagation paths in the string striking mode, i.e. during the recording processing in which vibration waveform data are recorded. FIG. 5B is a diagram showing vibration propagation paths in the string-striking preventing mode, i.e. during the sound board sound generation processing (reproduction processing) in which a tone (sound board vibration sound) is generated on the basis of vibration waveform data responsive to a key depression operation.

First, in the recording processing, as shown in FIG. 5A, individual keys 2 are depressed alone. Although the key depression may be performed through user's manual operations, the key depression may be automatically performed on a key-by-key basis via the key drive unit 30 because it is preferable that the keys be depressed with a constant intensity.

In the instant embodiment, a time period following striking of any one of the strings is considered as divided in two sections: an attack section that is a transitional section immediately following the striking of the string; and a sustain section following the end of the attack section. The attack section is a section lasting until resonance of the other strings 5 begins, and such a section is known in advance. Let it be assumed that the attack section is a time section lasting from the beginning of the string striking until a predetermined time elapses. A length of such a predetermined time may be differentiated depending on the sound pitch. Alternatively, a time section from the beginning of the string striking until an amplitude of a vibration waveform reaches a peak or a time section from the beginning of the string striking until the amplitude of the vibration waveform attenuates to a predetermined value after having passed the peak may be defined as the attack section. In FIGS. 5A and 5B, a letter "A" is attached to the head of each reference character indicative of an arrow showing a direction where vibrations of an attack section acts, while a letter "S" is attached to the head of each reference character indicative of an arrow showing a direction where vibrations of a sustain section acts.

In the recording processing, when the string 5-D corresponding to the depressed key 2 has been struck by the corresponding hammer 4, the corresponding damper 8 is not in contact with the string 5-D because the damper 8 has been moved upward out of contact with the string 5-D due to the key depression. As shown in FIG. 5A, first, vibrations of the struck string 5-D are transmitted to the bridge 6 (see arrow A1r), via which the vibrations are transmitted to the sound board 7 (arrow A2r). The vibrations of the sound board 7 in the attack section are audibly sounded in the air (arrow A5r), but also detected by the vibration sensor/actuator unit 50 (arrow A3r) and converted into a waveform signal (arrow ar) that is temporarily stored into the RAM 19 of the controller 1 and then stored into the storage device 12.

Once the sustain section arrives, the struck string 5-D too resonates, and such resonant vibrations transmit to the bridge 6 (arrow S1r). Meanwhile, the vibrations of the string 5-D in the attack section transmit via the bridge 6 (arrow A1r) to the other strings 5 (arrow A4r), so that the other strings 5 resonate in the sustain section. Such resonant vibrations of the other strings 5 transmit again to the bridge 6 (arrow S4r).

The resonant vibrations having transmitted to the bridge 6 in the sustain section transmit to the sound board 7 (arrow S2r). Thus, vibrations of the sound board 7 in the sustain section are sounded in the air (arrow S5r), and, meanwhile, the vibrations of the sound board 7 are detected by the vibration sensor/actuator unit 50 (arrow S3r) and converted into a waveform signal (arrow sr) that is temporarily stored into the RAM 19 of the controller 1 and then stored into the storage device 12.

Note that, although the data stored as vibration waveform data in the storage device 12 may be waveform data of all sections including the attack and sustain sections, the waveform of the sustain section need not necessarily be used. Thus, in the instant embodiment, it is assumed that the waveform data excluding the waveform data following the end of the attack section, i.e. only the vibration waveform of the attack section, are ultimately recorded as the vibration waveform data in the storage device 12.

Then, in the sound board sound generation processing (reproduction processing), the piano 1 is set in the string-striking preventing mode. In the string-striking preventing mode, striking of any strings 5 is prevented although the user can manually operate the keys 2 as in a normal performance, and, in place of striking of the strings 5, the sound board 7 is excited on the basis of the vibration waveform data stored in the storage device 12 so that a sound is generated on the basis of the vibrations of the sound board 7 in response to depression of any one of the keys 2. Namely, in the string-striking preventing mode, the controller 11 reads out to the RAM 19 only the waveform of the attack section (i.e., vibration waveform of the attack section) corresponding to the depressed key 2 from among the vibration waveform data recorded in the storage device 12. Then, as shown in FIG. 5B, the controller 11 sends a drive signal (arrow ap), generated by the signal generation section 15 on the basis of the read-out waveform data, to the vibration sensor/actuator unit 50. Thus, the vibration sensor/actuator unit 50 can excite the sound board 7 with the same vibration waveform (arrow A3p) with which the sound board 7 was vibrated during the recording processing (i.e., with the same vibration waveform as in the recording processing) (arrow A3r).

Vibrations of the thus-excited sound board 7 are audibly sounded in the air (arrow A5p) but also transmit to the bridge 6 (arrow A2p). The vibrations of the sound board 7 then transmit from the bridge 6 to the string 5-P and other strings 5 released from the dampers 8 due to the depression of the key 2 or operation of the pedal 8 (arrow A1p and arrow A4p). Thus, the string 5-P and the other strings 5 resonate, and such resonant vibrations (reverberation vibrations) transmit to the bridge 6 (arrows S1p and S4p), from which the resonant vibrations transmit to the sound board 7 (S2p) to be audibly sounded in the air (arrow S5p) but also transmit to the vibration sensor/actuator unit 50 (arrow S3p).

The sound audibly sounded in the air comprises a combination of the vibration sound from the sound board 7 excited on the basis of the vibration waveform of the attack section (arrow A5p) and the natural vibration sound based on the resonant vibration or reverberation vibration of the sustain section (arrow S5p), and such a sound has quality as equal as possible to the sound generated in the recording processing (namely, as equal as possible to a combination of the sound board vibration sound of active, attack characteristics responsive to string striking and the subsequent sound board vibration sound of passive, sustain characteristics). As a result, a sound very much similar to a sound generated in response to actual string striking can be generated without string striking response to key depression being actually executed.

If the sound board 7 is excited in accordance with the waveform data of the attack section as above, the strings 5 resonate, so that a vibration waveform of the sustain section can be automatically obtained through resonant vibrations or reverberation vibrations. Thus, only the waveform data of the attack section suffice as the waveform to be used for generation of the drive signal (i.e., excitation of the sound board 7); namely, the waveform data of the sustain section are not necessarily necessary for generation of the drive signal. Of course, the present invention is not so limited, and the waveform data (vibration waveform) of the sustain section may be recorded in advance so that, in reproduction, the sound board 7 can be excited in accordance with the recorded waveform data (vibration waveform) of the sustain section.

Next, with reference to FIGS. 6 and 7, a description will be given about example operational sequences of the recording processing and the sound board sound generation processing.

Figure 6:
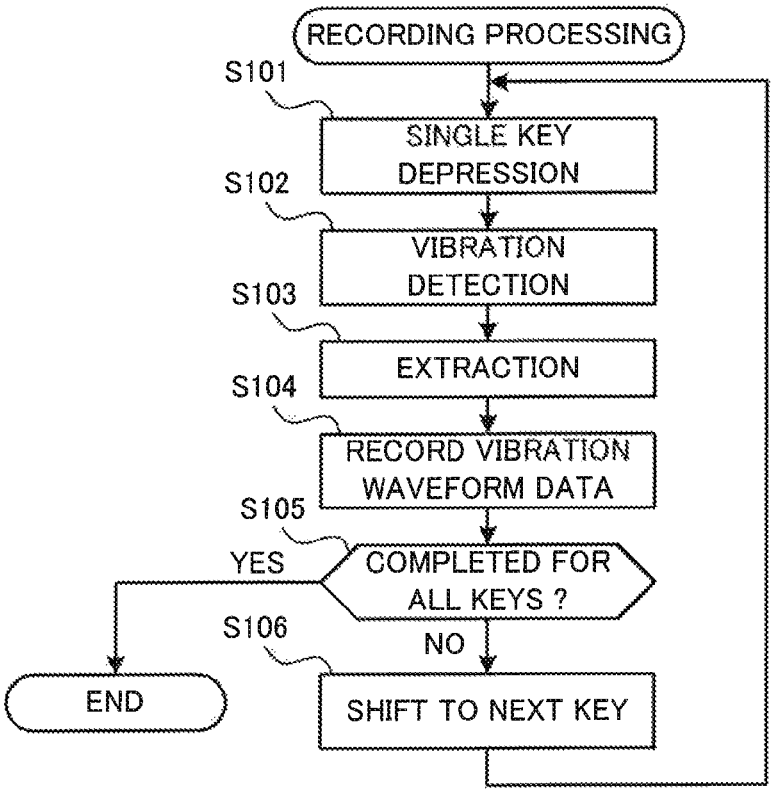
FIG. 6 is a flow chart of the recording processing performed in the embodiment of the grand piano.

FIG. 6 is a flow chart of the recording processing, which is performed by the CPU 18 of the controller 11. First, at step S101, the CPU sets the sound generation mode in the string striking mode as in a normal performance and issues an instruction for performing single key depression. In accordance with such an instruction, a single key is depressed, a string corresponding to the depressed single key is struck, and thus, a string vibration sound is generated from the piano 1 together with a sound board resonant sound. Note that the instruction for performing single key depression issued at step S101 may be one instructing that a key depression detection signal based on a user's manual key depression operation be received and instructing confirmation that single key depression responsive to the key depression detection signal has been executed, or one controlling the key drive unit 30 to automatically depress a particular single key. In the illustrated example, the instruction for performing single key depression issued at step S101 is one controlling the key drive unit 30 to automatically depress a particular single key. Namely, the CPU 18 controls the key drive unit 30 in such a manner that automatic operations are performed sequentially, for example, key by key starting with the key 2 of the lowermost pitch; for example, the key 2 of the lowermost pitch is depressed first. Note, however, that the keys may be depressed in any desired order. Then, at step S102, the CPU 18 controls the vibration sensor/actuator unit 50 to detect vibrations of the sound board 7 generated in response to the single key depression (arrows A3r or S3r).

Then, at step S103, the CPU 18 extracts, from among vibration waveform data corresponding to the operated key 2 obtained from the detection results of the vibration sensor/actuator unit 50, the waveform data other than the waveform data following the end of the attack section, to thereby practically obtain only the waveform data of the attack section. Then, at step S104, the CPU 18 records the waveform data of the attack section corresponding to the operated key 2 into the storage device 12 as vibration waveform data in association with the depressed key 2 (i.e., tone pitch of the key 2).

Note that the extraction of the waveform data of the attack section at step S103 may be performed as post-processing after temporary storage of the vibration waveform data (i.e., waveform data of the attack section and the sustain section) corresponding to all of the keys 2.

Then, at step S105, the CPU 18 makes a determination as to whether the single key depression has been completed for all of the keys 2. If the single key depression has not been completed for all of the keys 2 as determined at step S106 (NO determination at step S106), the key 2 to be depressed is shifted to the next key 2, i.e. the single key depression is performed on the next key 2 (i.e., the key 2 adjoining the last-depressed key 2 in the pitch increasing direction), after which the recording processing reverts to step S101. If, on the other hand, the single key depression has been completed for all of the keys 2 as determined at step S106 (YES determination at step S106), the recording processing is brought to an end.

In the string striking mode, i.e. in the recording processing, as seen from the foregoing, the controller 11 functions as a controller that performs control for storing the vibration waveforms, detected by a vibration waveform detector (50) in response to respective operations of the plurality of performance operation keys (keys 2), into a memory (storage device 12) in association with the performance operation keys (keys 2) (i.e., in association with the individual tone pitches). Note that the memory for storing the vibration waveforms is not limited to the storage device 12 and may be a removable or detachable, portable storage medium or an external storage device connected to the piano 1 via a network.

Figure 7:
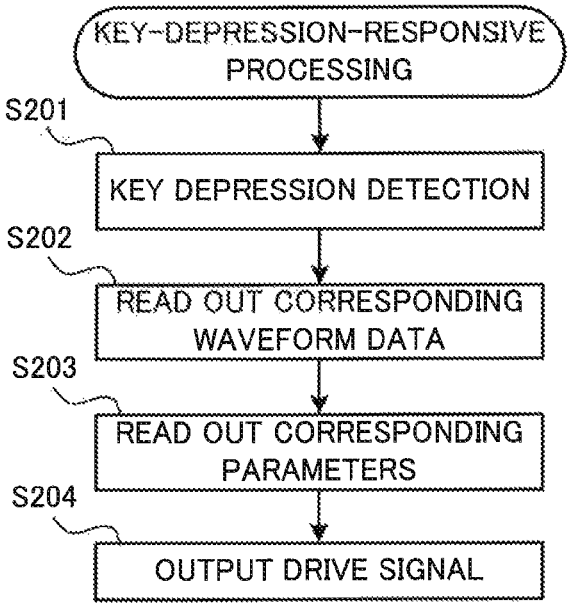
FIG. 7 is a flow chart of key-depression-responsive processing.

FIG. 7 is a flow chart of key-depression-responsive processing, which is performed by the CPU 18 of the controller 11. For the key-depression-responsive processing of FIG. 7, the sound generation mode is set in the string-striking preventing mode.

First, at step S201, the CPU 18 receives key depression detection information from any of the key sensors 22 via the interface 16 and detects which of the keys 2 has been depressed. Then, at step S202, the CPU 18 reads out the vibration waveform data corresponding to the key 2, whose depression has been detected, from the storage device 12.

Then, at step S203, the CPU reads out various corresponding parameters that include, among other things, not only settings of propriety, color or timbre and volume of generation of an electronic tone but also information for adjusting a volume of a generated sound based on vibrations of the sound board 7 (i.e., degree of excitation by the vibration sensor/actuator unit 50). These parameters are set in accordance with user's instructions input via the operation panel 13 or touch panel 60 and stored in registers etc. Note that the instant embodiment is designed to be capable of generating an electronic tone of a pitch corresponding to a depressed key in the string striking mode, and that the parameter for setting propriety of generation of an electronic tone is a parameter for selecting whether or not such an electronic tone should be generated in combination with a sound board vibration sound. Note that only the electronic tone may be generated (e.g., for listening via headphones) after having been subjected to processing as necessary with a volume of a sound to be generated by the sound board 7 set at zero (0) (i.e., without the sound board 7 being excited by the vibration sensor/actuator unit 50); such a mode is called "silent piano mode".

Then, at step S204, the CPU 18 performs control such that a drive signal is generated by the signal generation section 15 on the basis of the vibration waveform data corresponding to the current depressed key 2 and read out to the RAM 19 and such a generated drive signal is output to the drive circuit of the vibration sensor/actuator unit 50. For generation of the drive signal, key-on velocity information of the depressed key 2 too is referenced. Let it be assumed that, in the case where the generation of the electronic tone in combination of the sound board vibration sound is selected, an electronic tone signal too is generated at this step S204.

By the drive signal being supplied to the drive circuit of the vibration sensor/actuator unit 50 as above, vibrations corresponding to vibrations of the attack section are given to the sound board 7 (arrow A3p), so that a sound is generated from the sound board 7 in combination with subsequent resonant vibrations of the strings 5. Namely, first, the sound board 7 vibrates to generate a vibration sound and the strings 5 resonate in response to such vibrations of the sound board 7, so that resonant vibration sounds of the strings 5 are added to the vibration sound of the sound board 7 (arrows A5b and S5p). At that time, the dampers 8 behave in exactly the same manner as in the normal performance. Namely, with the pedal 3 held in the depressed position, rich resonant sounds can be generated by the strings 5. Further, upon release of any one of the keys 2 depressed with the pedal 3 held in the non-depressed position, the corresponding damper 8 silences the corresponding string 5.

With such arrangements, rich audible sounds with resonant sounds, similar to those generated when the piano 1 was performed as an acoustic piano, can be generated without actual string striking being performed. Besides, because actual string striking is not performed, it is possible to make desired sound volume adjustment while still maintaining natural sounds, but also it is possible to perform volume-suppressed sound reproduction. Thus, although no actual string striking is performed, it is possible to execute an automatically-damper-controlled, expressive sound board performance because the keys 2 are actually moved. With such actual movements of the keys 2, it is also possible to increase a realistic sensation of an automatic performance.

In the string-striking mode, i.e. in the reproduction processing, as set forth above, the controller 11 functions as a controller that reads out from the memory (storage device 12) the vibration waveform corresponding to the performance operation key (key 2) whose operation has been detected by the operation detector (key sensor 22) and inputs a waveform signal based on the read-out vibration waveform to the excitation device (50).

According to the first embodiment, the vibration sensor/actuator unit 50, functioning as both an excitation means or device and a vibration waveform detection means or section, is provided on a portion of the sound board 7 close to the bridge 6, and vibration waveform data are recorded on the basis of detection results of a vibration waveform of the sound board 7 during the single key depression. Then, in the sound board sound generation processing, a drive signal corresponding to the depressed key 2 is generated, on the basis of the vibration waveform data, to vibrate the sound board 7 by means of the vibration sensor/actuator unit 50 in the string-striking preventing mode. Thus, in a performance, the instant embodiment can faithfully reproduce the same acoustic characteristics of the sound board of an acoustic piano but also can generate a sound board vibration sound with sound volume adjustment made thereto as necessary.

Further, because the vibration sensor/actuator unit 50 comprises one and the same hardware functioning both as the excitation device and as the vibration waveform detector, its vibration detecting position and its exciting position can completely coincide with each other. Thus, the instant embodiment can not only even more faithfully reproduce the same acoustic characteristics as presented in the vibration waveform data recording, but also achieve a simplified construction by minimizing increase in the number of necessary component parts.

Further, because the vibration waveform data to be recorded may be the waveform data other than the waveform data following the end of the attack section (i.e., the vibration waveform data to be recorded may be the vibration waveform of the attack section), the instant embodiment can simplify the structure of the stored data. Also, because the drive signal is generated using only the vibration waveform of the attack section, the instant embodiment can suppress excessive resonance from being added to the sustain section so that a resonant sound in particular can be reproduced even more faithfully.

<Second Embodiment>

A second embodiment of the present invention is generally similar to the above-described first embodiment, except for positions of the vibration sensor/actuator units 50. Namely, in the second embodiment, each of the vibration sensor/actuator units 50 is connected to the bridge 6 rather than to the sound board 7.

Figure 8A:
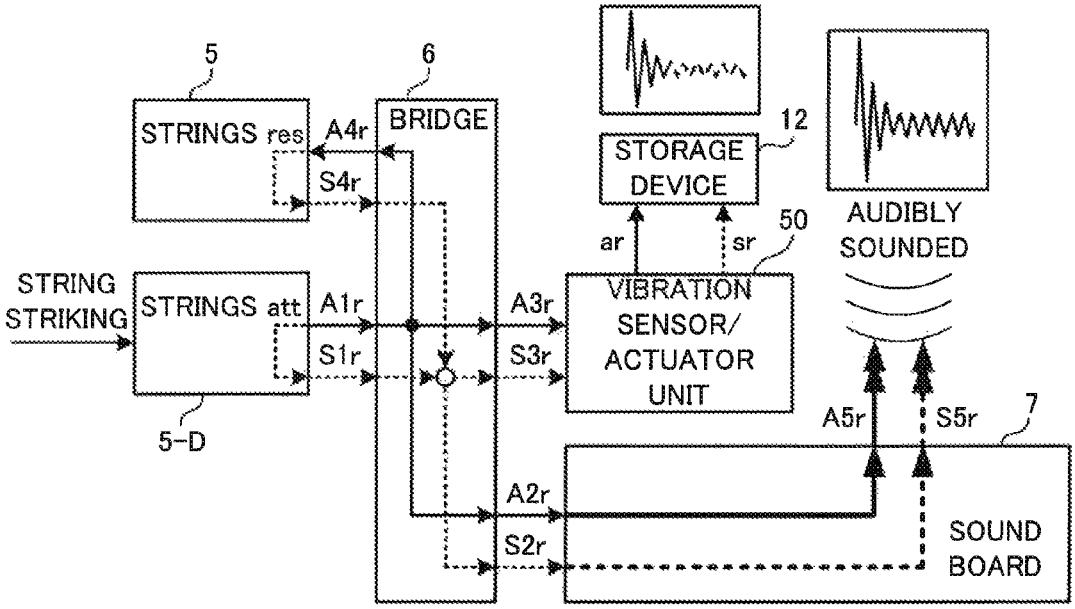
FIG. 8A is a diagram showing propagation paths of vibrations during the recording processing where vibration waveform data are recorded in the string striking mode in a second embodiment of the piano.
Figure 8B:
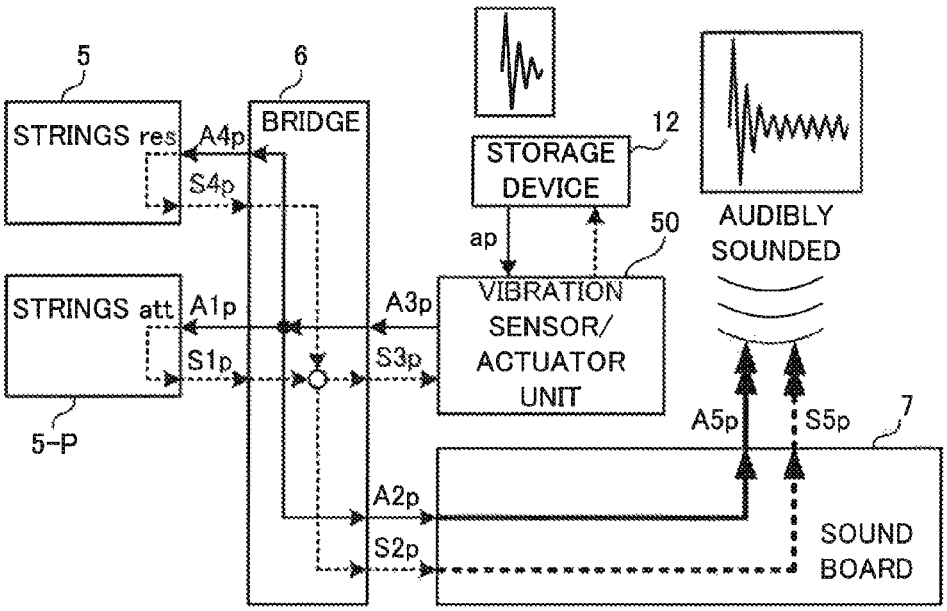
FIG. 8B is a diagram showing propagation paths of vibrations during the sound board sound generation processing (reproduction processing) where tones (sound board vibration sounds) are audibly generated on the basis of vibration waveform data in a performance in the string-striking preventing mode.

FIG. 8A is a diagram showing propagation paths of vibrations during the recording processing in which music piece reproducing data are recorded in the string striking mode. FIG. 8B is a diagram showing propagation paths of vibrations during the sound board sound generation processing (reproduction processing) in which tones are generated via the sound board on the basis of the vibration waveform data in a performance in the string-striking preventing mode.

Vibrations of the string 5-D struck by the corresponding hammer transmits from the string 5-D to the bridge 6 (arrow Air), then the bridge 6 to the sound board 7 (arrow A2r) and then audibly sounded (arrow A5r), as shown in FIG. 8A. Meanwhile, the vibrations of the string 5-D transmits via the bridge 6 to the other strings 5 (arrow A4r) but also transmits via the bridge 6 to the vibration sensor/actuator unit 50 (arrow A3r) and recorded into the storage device 12 (arrow ar).

Once the sustain section arrives, the string 5-D too resonates and the resonant vibrations of the string 5-D transmit to the bridge 6, in parallel with which resonant vibrations of the other strings transmit to the bridge 6 (arrow S4r). Then, the vibrations transmit from the bridge 6 to the sound board 7 to be audibly sounded (S5r). Meanwhile, the vibrations transmit from the bridge 6 to the vibration sensor/actuator unit 50 (arrow S3r) and recorded into the storage device 12 (arrow sr).

In the sound board sound generation processing (piece reproduction processing), a drive signal similar to the drive signal shown in FIG. 5B is supplied to the vibration sensor/actuator unit 50 (arrow ap), as shown in FIG. 8B. Thus, the vibration sensor/actuator unit 50 can excite the bridge 6 in accordance with the same vibration waveform (arrow A3p) as the vibration waveform of the bridge 6 in the attack section in the recording processing (arrow A3r of FIG. 8A).

As the bridge 6 is excited, vibrations of the bridge 6 in the attack section transmit to the string 5-P and other strings 5 (arrows A1p and A4p) so that the string 5-P and the other strings 5 resonate. Meanwhile, the vibrations of the bridge 6 transmit to the sound board 7 (arrow A2p) and then audibly sounded (arrow A5p). Further, the resonant vibrations of the string 5-P and the other strings 5 become vibrations of the sustain section that transmit from the string 5-P to the bridge 6 (arrow S1p) and from the other strings 5 to the bridge 6 (arrow S4p). Then, the vibrations transmit from the bridge 6 to the sound board 7 to be audibly sounded (arrow S5p), in parallel with which the vibrations transmit from the bridge 6 to the vibration sensor/actuator unit 50 (arrow S3p).

With such arrangements, the second embodiment can achieve the same advantageous benefits as the first embodiment; namely, in a performance, the second embodiment can faithfully replicate or reproduce the acoustic characteristics of an acoustic piano and permits sound volume adjustment.

Whereas the vibration sensor/actuator unit 50 provided in the first and second embodiments of the invention has been described as a single hardware component functioning as both the excitation device and the vibration waveform detector, the excitation device and the vibration waveform detector may be provided separately from each other as noted above. In such a case, the excitation device and the vibration waveform detector may be disposed on the bridge 6 or on a portion of the sound board 7 close to the bridge 6. Because, if the excitation device and the vibration waveform detector are within such a region, no significant differences would arise irrespective whether the excitation device and the vibration waveform detector are on the bridge 6 or on the sound board 7. Anyway, in order to achieve faithful reproduction of sounds, it is desirable that the excitation device and the vibration waveform detector be located as close to each other as possible.

Further, the vibration waveform data may be temporarily recorded in a portable medium or the like and read out and used as necessary without being limited to being recorded in the storage device 12 provided in the grand piano 1. Whereas it is most desirable that the piano that performs the vibration waveform data recording processing and the piano that performs the sound board sound generation processing by use of the vibration waveform data be one and the same piano, the present invention is not so limited, and the sound board sound generation processing may be performed by separate pianos of a same model.

It should be appreciated that the piano to which the basic principles of the present invention are applied may be of the upright type rather than the grand type as along as it has a sound board capable of being compulsorily vibrated. Further, the basic principles of the present invention may be applied to any other musical instruments than pianos; note that the "musical instruments" to which the basic principles of the present invention are not necessary limited to real musical instruments and may be musical-instrument-type toys, equipment having similar functions to musical instruments, and the like. Furthermore, apparatus constructed to have only the reproduction function without having the recording function are also included in the scope of the present invention. Namely, the present invention may be constructed as a sound reproduction apparatus, which comprises: a sound board; an excitation device physically excitable in accordance with an input waveform signal and disposed in such a manner that physical vibrations generated by the excitation device are transmitted at least to the sound board; a plurality of performance operation keys; an operation detector configured to detect respective operations of the plurality of performance operation keys; a memory storing therein vibration waveforms corresponding to individual ones of the plurality of performance operation keys in association with the individual ones of the plurality of performance operation keys; and a controller is configured to read out, from the memory, the vibration waveform corresponding to the performance operation key whose operation has been detected by the operation detector and input a waveform signal based on the read-out vibration waveform to the excitation device, so that physical vibrations according to the input waveform signal are generated by the excitation device and a sound is generated by at least the sound board physically vibrating in response to the physical vibrations generated by the excitation device.

This application is based on, and claims priority to, JP PA 2012-264191 filed on 3 Dec. 2012. The disclosure of the priority application, in its entirety, including the drawings, claims, and the specification thereof, are incorporated herein by reference.

What is claimed is:

1. A musical instrument comprising:

a plurality of performance operation keys;

a plurality of sounding members provided in corresponding relation to said plurality of performance operation keys;

a sound board;

a plurality of striking members provided in corresponding relation to said plurality of performance operation keys and each configured to physically vibrate a corresponding one of the sounding members in response to an operation of the corresponding one of the performance operation keys;

a plurality of transmission joints provided in corresponding relation to said plurality of sounding members and each disposed to physically transmit vibrations of a corresponding one of the sounding members to said sound board;

an operation detector configured to detect respective operations of said plurality of performance operation keys;

a vibration waveform device configured to:

detect a vibration waveform corresponding to vibrations of at least one of said sound board or the transmission joints; and vibrate said sound board in accordance with an input waveform signal;

a controller configured to control storing of the vibration waveforms detected by said vibration waveform detector, in response to respective operations of the performance operation keys, in a memory in association with individual ones of the performance operation keys; and read out, from the memory, the vibration waveform corresponding to the performance operation key whose operation has been detected by said operation detector and input a waveform signal based on the read-out vibration waveform to said vibration waveform device to induce physical vibrations to said sound board according to the input waveform signal.

2. The musical instrument as claimed in claim 1, wherein the vibration waveform stored by said controller into the memory is a vibration waveform of an attack section of a sound, said attack section lasting until resonance of any of the sounding members other than one of the sounding members having been struck in response to an operation of one of the performance operation keys begins.

3. The musical instrument as claimed in claim 1, further comprising:

a drive unit configured to automatically drive the individual ones of said plurality of performance operation keys, and wherein said controller controls storing of the vibration waveforms detected by said vibration waveform device, in response to operations of the performance operation keys automatically driven by said drive unit, in the memory in association with the performance operation keys.

4. The musical instrument as claimed in claim 1, wherein each of the sounding members is a string, each of the striking members is a hammer, and each of the transmission joints is a bridge provided on said sounding member for supporting the string in a stretched-taut state.

5. A computer-implemented method of storing performance information of a musical instrument, wherein the musical instrument comprises:

a plurality of performance operation keys;

a plurality of sounding members provided in corresponding relation to the plurality of performance operation keys;

a sound board;

a plurality of striking members provided in corresponding relation to the plurality of performance operation keys and each configured to physically vibrate a corresponding one of the sounding members in response to an operation of the corresponding one of the performance operation keys;

a plurality of transmission joints provided in corresponding relation to the plurality of sounding members and each disposed to physically transmit vibrations of a corresponding one of the sounding members to said sound board;

an operation detector configured to detect respective operations of the plurality of performance operation keys;

a vibration waveform device configured to:

detect a vibration waveform corresponding to vibrations of at least one of the sound board or the transmission joints; and vibrate the sound board in accordance with an input waveform signal, and wherein the method comprises the steps of:

operating any one of the plurality of performance operation keys and physically vibrating a corresponding one of the sounding members via the striking member corresponding to the operated performance operation key;

detecting a vibration waveform corresponding to vibrations of at least one of the sound board or the transmission joints with the vibration waveform device;

storing the detected vibration waveforms, in response to respective operations of the performance operation keys, in a memory in association with the performance operation keys;

detecting respective operations of the plurality of performance operation keys with the operation detector;

reading out, from the memory, the vibration waveform corresponding to the performance operation key whose operation has been detected; and inputting a waveform signal based on the read-out vibration waveform to the vibration waveform device to vibrate the sound board according to the input waveform signal.

6. A non-transitory computer-readable storage medium storing a program executable by a processor to perform a method of storing performance information of a musical instrument:

wherein the musical instrument comprises:

a plurality of performance operation keys;

a plurality of sounding members provided in corresponding relation to the plurality of performance operation keys;

a sound board;

a plurality of striking members provided in corresponding relation to the plurality of performance operation keys and each configured to physically vibrate a corresponding one of the sounding members in response to an operation of the corresponding one of the performance operation keys;

a plurality of transmission joints provided in corresponding relation to the plurality of sounding members and each disposed to physically transmit vibrations of a corresponding one of the sounding members to said sound board, an operation detector configured to detect respective operations of the plurality of performance operation keys;

a vibration waveform device configured to:

detect a vibration waveform corresponding to vibrations of at least one of the sound board or the transmission joints; and vibrate the sound board in accordance with an input waveform signal, wherein the method comprises:

operating any one of the plurality of performance operation keys and physically vibrating a corresponding one of the sounding members via the striking member corresponding to the operated performance operation key;

detecting a vibration waveform corresponding to vibrations of at least one of the sound board or the transmission joints;

storing the detected vibration waveforms, in response to respective operations of the performance operation keys, in a memory in association with the performance operation keys;

detecting respective operations of the plurality of performance operation keys with the operation detector;

reading out, from the memory, the vibration waveform corresponding to the performance operation key whose operation has been detected; and inputting a waveform signal based on the read-out vibration waveform to the vibration waveform device to vibrate the sound board according to the input waveform signal.

* * * * *